US006523385B2

(12) United States Patent
Häusler

(10) Patent No.: US 6,523,385 B2
(45) Date of Patent: Feb. 25, 2003

(54) PROCESS FOR PREPARING THE END OF A PIPE FOR DRAWING OVER A MANDREL

(75) Inventor: Karl Heinz Häusler, Korschenbroich (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/855,792

(22) Filed: May 15, 2001

(65) Prior Publication Data

US 2001/0042394 A1 Nov. 22, 2001

(30) Foreign Application Priority Data

May 17, 2000 (DE) ..... 100 24 647

(51) Int. Cl.[7] ..... B21D 22/00

(52) U.S. Cl. ..... 72/85; 72/121; 72/283; 72/370.01; 72/370.24

(58) Field of Search ..... 72/84, 85, 120, 72/121, 208, 214, 283, 370.01, 370.02, 370.24

(56) References Cited

U.S. PATENT DOCUMENTS

| | | | | |
|---|---|---|---|---|
| 2,882,851 A | * | 4/1959 | Graves | 72/370.1 |
| 3,299,680 A | * | 1/1967 | Thompson | 72/370.01 |
| 4,038,850 A | * | 8/1977 | Sakagami | 72/85 |
| 4,648,728 A | * | 3/1987 | LaCount et al. | 72/85 |
| 6,038,901 A | * | 3/2000 | Stein et al. | 72/85 |

FOREIGN PATENT DOCUMENTS

| | | |
|---|---|---|
| DE | 43 13 648 | 10/1994 |

* cited by examiner

*Primary Examiner*—Ed Tolan
(74) *Attorney, Agent, or Firm*—Cohen, Pontani, Lieberman & Pavane

(57) ABSTRACT

A process for preparing the end of a pipe for drawing over a drawing mandrel, including the following steps: (a) inserting a preforming mandrel into an end of the pipe, the preforming mandrel having a first section having a diameter which is substantially smaller than the inside diameter of the pipe to be drawn, a third section having a diameter which is substantially the same as the inside diameter of the pipe to be drawn, and a second section between the first section and the third section, the second section tapering from the diameter of the third section to the diameter of the first section; (b) rolling the pipe with a set of non-driven rolls while the rolls revolve around the pipe and move axially from the first section of the mandrel to the second section of the mandrel and radially inward to from a constriction in the pipe; (c) rolling the pipe with the rolls while the rolls revolve around the pipe and move axially over the second section of the mandrel toward the third section of the preforming mandrel and radially outward so that the pipe has a wall thickness which is continuously reduced as the diameter of the mandrel increases toward the third section; and (d) rolling the pipe with the rolls while the rolls revolve around the pipe and move axially over the third section of the preforming mandrel so that the pipe has a wall thickness which remains constant over the third section to the end of the pipe. The preforming mandrel is then removed so that a drawing mandrel can be inserted and the pipe can be drawn through a drawing mill. Apparatus for practicing the invention is also disclosed.

6 Claims, 2 Drawing Sheets

PROCESS FOR PREPARING THE END OF A PIPE FOR DRAWING OVER A MANDREL

BACKGROUND OF THE INVENTION

1. Field of the Invention

The invention pertains to a process for preparing the end of a pipe for drawing over a mandrel, and to a rolling mill for performing the method.

2. Description of the Related Art

When pipes of considerable length are drawn with a flying mandrel, cracks often occur during the initial phase of the drawing operation. This is caused by the eccentricity of the pipe, that is, by its irregular wall thickness. Thus, when a dent is made in one side of the pipe so that the mandrel can be carried along, the longitudinal axis of the mandrel may not be exactly horizontal in the pipe, i.e., coaxial with the axis of the pipe. When drawing is started, it is therefore possible for the mandrel to enter the drawing ring at a slant, which causes the pipe to crack at this point.

From the technical literature (Herstellung von Rohren [Production of Pipes], Verlag Stahleisen mbH, Düsseldorf, 1975, p. 21, lines 5–12) it is known that rolling processes with slanted rolls are able to improve the wall thickness tolerance and thus also correct the eccentricity of the pipe. The worse the eccentricity of the pipe to be rolled, the greater is the improvement. This is true not only for rolling from the heat of rolling, but also for cold-rolling processes such as the transverse or press-rolling of pipes. Especially effective in this case are three-roll rolling mills, because the arrangement of the three rolls has the effect of uniquely determining the geometry of the rolling process. A tolerance-improving effect begins at an elongation or stretching of the rolling stock of only 10%. The effect increases with the degree of elongation.

DE 43 13 648 discloses an apparatus for the stepwise stretching of pipes. With the help of this device, considerable reductions in wall thickness can be achieved, which are similar to those of the known Pilger cold rolling process.

SUMMARY OF THE INVENTION

The object of the invention is to provide a process for improving the initial drawing conditions with a flying mandrel during straight drawing or even drawing with bull blocks can be improved.

This object is achieved by a process for preforming the end of the pipe to be drawn by inserting a preforming mandrel and rolling the pipe against the mandrel to form a constriction.

In the solution according to the invention, instead of a dent pressed into one side of the pipe, a constriction extending all the way around the pipe is introduced, which forces the drawing mandrel into a horizontal position, i.e. coaxial with the axis of the pipe, during the initial drawing phase. In addition, the setup for introducing the constriction is combined with the setup for reducing the eccentricity, and the two different work steps are thus executed in a single pass.

According to the invention, to improve the eccentricity of the end of the pipe to be drawn, a three-roll rolling apparatus with non-driven rolls spaced 120° apart is used, the rolling head of which revolves around the pipe. The rolls can be tightened inward in the radial direction during the rolling process, so that the rolls can travel over a specific contour on the surface of the pipe.

A mandrel having a tapered tip and a section with a diameter corresponding to the inside diameter of the pipe is inserted in the pipe. The tip comprises a first section which is substantially smaller than the inside diameter of the pipe and a second or intermediate section which corresponds to the contour of a constriction to be rolled into the pipe. The third section is the section having a diameter corresponding to the inside diameter of the pipe. The second section has a concavely curved surface which tapers from the diameter of the third section the diameter of the first section. The rolls are brought into contact with the outside of the pipe adjacent to the first section of the mandrel. When the rolls are tightened inward as the rolling head rotates and moves axially toward the second section, a circumferential constriction is rolled into the pipe. The rolling head is then moved axially relative to the mandrel, toward the third section, as the head rotates and the rolls move radially outward. The constriction thereby assumes a contour corresponding to the diameter of the second section of the mandrel. As a result of the three-roll arrangement, the eccentricity is improved simultaneously with a reduction in the wall thickness. The head continues to rotate while moving axially with respect to the third section of the mandrel so that the desired reduced thickness is achieved to the end of the pipe. After this rolling step, one or more drawing mandrels are pushed into the end of the pipe, and a drawing device is fixed to the end of the pipe. The drawing mandrel has a tapered end which abuts the constriction and is thereby coaxially aligned in the pipe prior to drawing.

The ratio δ between the unrolled and the rolled cross section of the pipe is determined as follows:

$$\delta=(D_0/S_0)/(D_1/S_1)\geqq 0.75\leqq 0.95.$$

where:

$\delta$=the reduction ratio;

$D_0$=the outside diameter of the pipe before rolling;

$D_1$=the outside diameter of the pipe after rolling;

$S_0$=the wall thickness of the pipe before rolling; and $S_1$=the wall thickness of the pipe after rolling.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
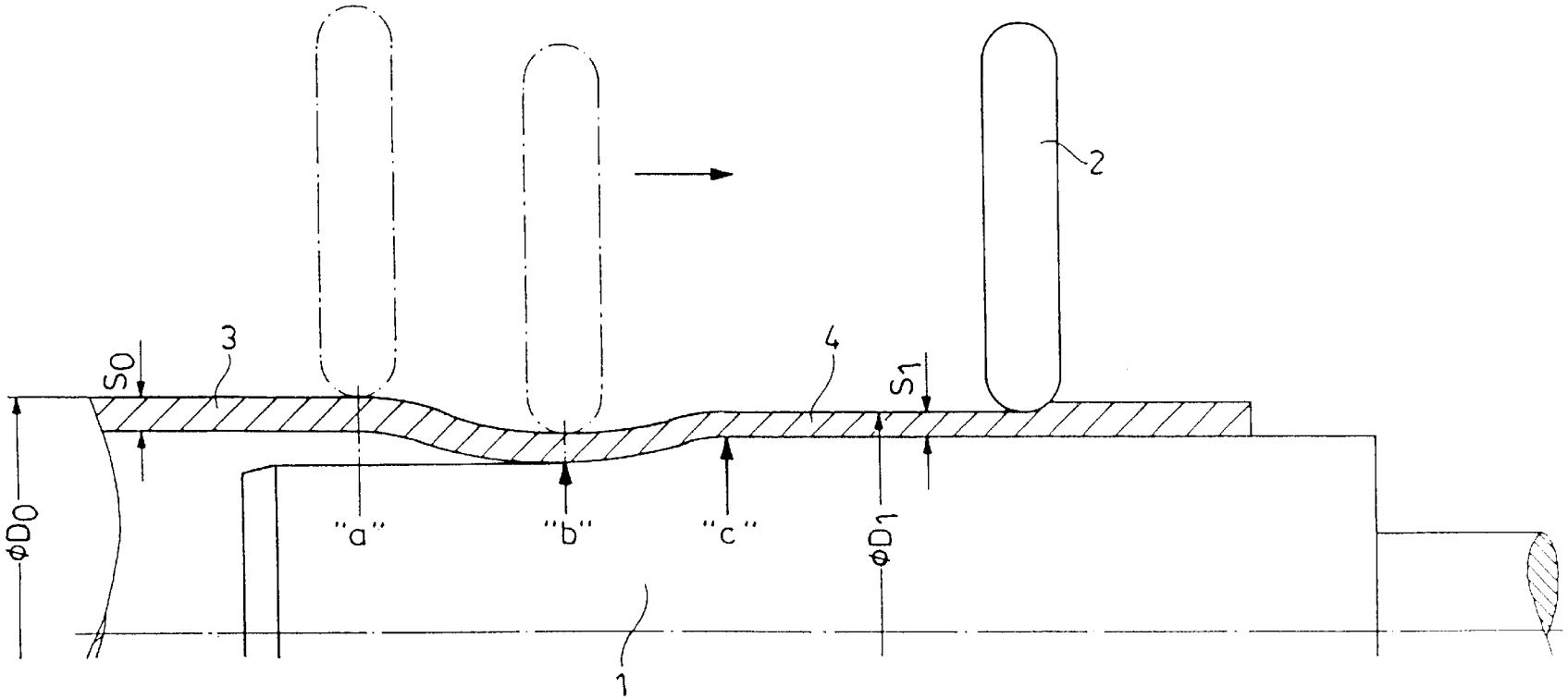
FIG. 1 is a longitudinal section through the end of the pipe during the rolling process.

FIG. 1 shows a longitudinal cross section through the end 3 of the pipe. At the end of the pipe, a preforming mandrel 1 is inserted as an internal tool, which at the same time is a component of the rolling device 5 with the rolls 2. As the mandrel is pushed forward into the pipe, the rolls travel along with it, until they reach the position "a".

Starting at the beginning of the return stroke, proceeding in the direction of the arrow, the rolls are moved axially with respect to the mandrel while being brought inward in a controlled manner until position "b" is reached and thus produce a constriction 8 in the pipe, without causing any reduction in the wall thickness $S_0$. Now the rolls are opened radially outward again until position "c" is reached, thinning out the wall continuously to the finished wall thickness $S_1$. Starting from position "c", a pipe section 4 with a constant wall thickness $S_1$ continues to be rolled out until the end of the pipe is reached. Then the mandrel 1 is pulled back out. Note well, that the inner diameter of the prepared pipe at the constriction 8, is less than the inner diameter on either axial side, and can thereby serve as a centering stop for the drawing mandrel.

The continuously thinned wall extending from section "b" to section "c" brings about a gradual increase in the drawing force as the pipe passes through the drawing ring. That is, there is no abrupt increase in this force. As a result, the danger of cracking is reduced.

As a general rule, the thinning of the wall can be achieved in a single pass through the rolls. In the case of difficult to form materials, however, it may be necessary to repeat the process one or more times.

Figure 2:
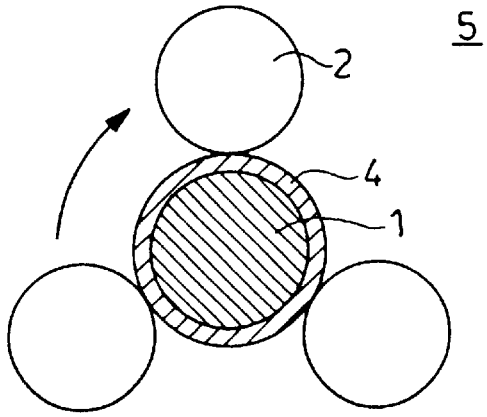
FIG. 2 is an end view of the three rolls of the rolling apparatus.

FIG. 2 is a schematic view of the rolling apparatus 5 with three rolls 2 and a mandrel 1 inserted into the pipe 4. The number of rolls can also be more or less than three.

Figure 3:
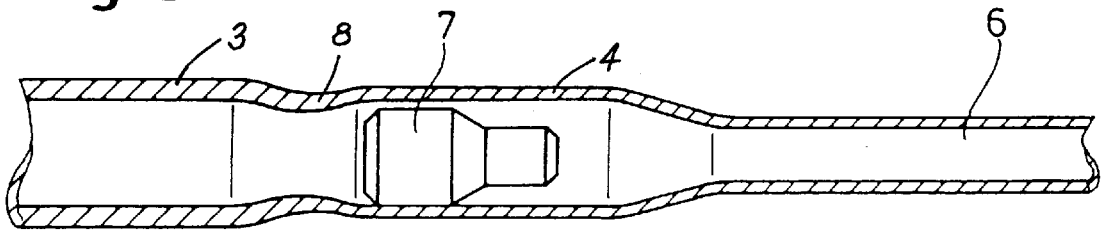
FIG. 3 shows the end of the pipe prepared according to the invention, prior to final drawing.

FIG. 3 shows the prepared end 3 of a pipe, having a constriction 8 and a reduced thickness section 4 according to the invention. The pipe is shown with a drawing mandrel 7 inserted against the constriction 8 and a drawing device 6 attached, prior to the final drawing step or steps.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A process for preparing the end of a pipe for drawing over a drawing mandrel, said process comprising the following steps:

(a) inserting a preforming mandrel into an end of the pipe, said preforming mandrel comprising a first section having a diameter which is substantially smaller than the inside diameter of the pipe to be drawn, a third section having a diameter which is substantially the same as the inside diameter of the pipe to be drawn, and a second section between said first section and said third section, said second section tapering from the diameter of the third section to the diameter of the first section;

(b) rolling said pipe with a set of non-driven rolls while said rolls revolve around the pipe and move axially from said first section of said mandrel to said second section of said mandrel and radially inward to form a constriction in said pipe;

(c) rolling said pipe with said rolls while said rolls revolve around the pipe and move axially over said second section of said mandrel toward said third section of said preforming mandrel and radially outward so that the pipe has a wall thickness which is continuously reduced as the diameter of the mandrel increases toward the third section; and (d) rolling said pipe with said rolls while said rolls revolve around the pipe and move axially over said third section of said preforming mandrel so that the pipe has a wall thickness which remains constant over the third section to the end of the pipe.

2. A process according to claim 1, wherein steps (a) to (d) are repeated.

3. A process according to claim 1 further comprising (e) removing said preforming mandrel from said pipe;

(f) inserting a drawing mandrel into said pipe;

(g)attaching a drawing device to said pipe; and (h) drawing said pipe over said drawing mandrel.

4. Process according to claim 1, wherein the reduction ratio δ between the unrolled and the rolled pipe cross section is defined as follows:

ti $\delta=(D_0/S_0)/(D_1/S_1)\geqq 0.75\leqq 0.95$.

where:

δ=the reduction ratio;

$D_0$=the outside diameter of the pipe before rolling;

$D_1$=the outside diameter of the pipe after rolling;

$S_0$=the wall thickness of the pipe before rolling; and $S_1$=the wall thickness of the pipe after rolling.

5. An apparatus for preparing the end of a pipe for drawing over a drawing mandrel, said apparatus comprising (a) a preforming mandrel comprising a first section having a diameter which is substantially smaller than the inside diameter of the pipe to be drawn, a third section having a diameter which is substantially the same as the inside diameter of the pipe to be drawn, and a second section between said first section and said third section, said second section comprising a concavely curved surface which tapers from the diameter of the third section to the diameter of the first section;

(b) a rolling head which can move axially relative to a pipe to be prepared and which can revolve around said pipe to be prepared, said rolling head comprising a plurality of non-driven rolls distributed on a circle and movable radially, whereby, upon inserting said preforming mandrel into the end of said pipe and rolling said pipe with said nondriven rolls while said rolls revolve around the pipe and move axially from said first section of said mandrel to said second section or said mandrel and radially inward, a constriction can be formed in said pipe, and upon rolling said pipe with said rolls while said rolls revolve around the pipe and move axially over said second section of said mandrel toward said third section of said preforming mandrel and radially outward, the pipe can be provided with a wall thickness which is continuously reduced as the diameter of the mandrel increases toward the third section; and upon rolling said pipe with said rolls while said rolls revolve around the pipe and move axially over said third section of said preforming mandrel, the pipe can be provided with a wall thickness which remains constant over the third section to the end of the pipe.

6. An apparatus as in claim 5 wherein said rolling head comprises three rolls spaced 120 degrees apart.

* * * * *